US011690465B2

(12) United States Patent
Gray, III et al.

(10) Patent No.: US 11,690,465 B2
(45) Date of Patent: Jul. 4, 2023

(54) SEAMLESS PILLOW OR PILLOW COMPONENT

(71) Applicant: Standard Fiber, LLC, Burlingame, CA (US)

(72) Inventors: W. Alexander Gray, III, Whitefish, MT (US); Chun Leung Chan, San Francisco, CA (US)

(73) Assignee: Standard Fiber, LLC, Burlingame, CA (US)

( * ) Notice: Subject to any disclaimer, the term of this patent is extended or adjusted under 35 U.S.C. 154(b) by 359 days.

(21) Appl. No.: 17/029,958

(22) Filed: Sep. 23, 2020

(65) Prior Publication Data

US 2021/0093106 A1 Apr. 1, 2021

Related U.S. Application Data

(60) Provisional application No. 62/907,261, filed on Sep. 27, 2019.

(51) Int. Cl.
*A47G 9/10* (2006.01)
*A47G 9/02* (2006.01)

(52) U.S. Cl.
CPC ..... *A47G 9/1036* (2013.01); *A47G 9/0253* (2013.01)

(58) Field of Classification Search
CPC ..... A47G 9/1036; A47G 9/0253; A47G 9/10
See application file for complete search history.

(56) References Cited

U.S. PATENT DOCUMENTS

| | | | | |
|---|---|---|---|---|
| 3,992,733 | A | 11/1976 | Racine | |
| 2013/0019409 | A1* | 1/2013 | Blazar | A47G 9/1027 5/644 |
| 2016/0281279 | A1* | 9/2016 | Liran | D04B 1/18 |
| 2017/0145596 | A1 | 5/2017 | Hays et al. | |
| 2018/0303257 | A1* | 10/2018 | Alletto, Jr. | A47G 9/10 |
| 2019/0017200 | A1* | 1/2019 | Alletto, Jr. | D04B 1/123 |
| 2019/0282005 | A1* | 9/2019 | Alletto, Jr. | A47G 9/04 |

FOREIGN PATENT DOCUMENTS

| | | | | |
|---|---|---|---|---|
| WO | WO-2019063476 | A1 * | 4/2019 | A47G 9/0253 |
| WO | WO-2019147794 | A1 * | 8/2019 | A47C 21/046 |

OTHER PUBLICATIONS

International Preliminary Report on Patentability and Written Opinion issued by International Bureau in connection with PCT/US2020/052393 dated Mar. 15, 2022.

* cited by examiner

*Primary Examiner* — Eric J Kurilla
(74) *Attorney, Agent, or Firm* — Levenfeld Pearlstein, LLC

(57) ABSTRACT

A pillow component includes a material layer having a top layer, a bottom layer and one or more sides separating the top layer from the bottom layer, and an interior spaced defined between the top layer and the bottom layer, the interior space configured to receive a filler. The material layer is formed by seamless knitting and is seamless about an entirety of a periphery extending in a first direction around the top layer, the bottom layer and the one or more sides. The characteristics of the knit material layer or fabric can be widely varied. A pillow includes the pillow component and a filler in the interior space.

18 Claims, 3 Drawing Sheets

SEAMLESS PILLOW OR PILLOW COMPONENT

CROSS-REFERENCE TO RELATED APPLICATION DATA

This application claims the benefit of and priority to Provisional U.S. Patent Application Ser. No. 62/907,261, filed Sep. 27, 2019, titled Seamless Pillow or Pillow Component, the disclosure of which is incorporated herein in its entirety.

BACKGROUND

The following description relates to a pillow or pillow component such as a pillow cover, protector, or pillowcase.

A known pillow includes a cover made from two or more panels of material joined to one another to define an enclosed or partially enclosed space. A filler material is received in the space. One known pillow includes two similarly dimensioned panels. The panels are aligned with one another in a stacked configuration and joined together along their respective peripheries, for example, by stitching.

However, the process above requires relatively precise alignment of panels and a relatively large amount of stitching, both of which can be time consuming. This is especially that case when it is desired to vary patterns, materials, material colors, fiber density, material characteristics such as stretch, air flow (breathability), cooling, and the like, in a single product, for example, in a pillow case. In addition, excess material is needed for the stitching process which can increase the amount of material needed for the product.

Further, the known pillows are relatively inflexible with respect to the amount of filler material that may be received in the enclosed space. Thus, some users may find it difficult to achieve a desired cushioning or support effect from the pillow. Further still, the filler material in the known pillows may become unevenly distributed or moved toward the periphery of the pillow which may negatively affect comfort and support as perceived by the user.

Accordingly, it is desirable to provide a pillow and/or pillow component having a material layer which does not require alignment and joining of multiple panels and may control distribution of a filler in an interior space. Desirably, such a pillow or pillow component allows for varying patterns, materials, material colors and fiber density. More desirably still, such a pillow and/or pillow component allows for varying material characteristics such as stretch, air flow (breathability), cooling, and the like without aligning and joining multiple panels.

SUMMARY

In one embodiment, a pillow component includes a material layer having a top layer, a bottom layer and one or more sides separating the top layer from the bottom layer, and an interior spaced defined between the top layer and the bottom layer and configured to receive a filler. The material layer is formed by seamless knitting and is seamless about an entirety of a periphery extending in first direction around the top layer, the bottom layer and the one or more sides.

The material layer may include a plurality of sides. At least two opposed sides of the plurality of sides may be seamless. The material layer may include a seam at a third side of the plurality of sides. The material layer may include an opening at a fourth side of the plurality of sides, opposite to the third side. The material layer may include a fastener at a fourth side of the plurality of sides, opposite to the third side. The fastener may be a releasable fastener. In one embodiment, at least one side of the plurality of sides may be inwardly curved.

The material layer can be knit from more than one type of yarn. The yarns may have differing characteristics. For example, one such characteristic is a cooling characteristic.

The material layer can be knit having more than one density of yarn. The varying density can vary the stretch, the breathability and/or cooling ability of the material layer. The pillow component may be knit such that at least one side of the plurality of sides is inwardly curved.

The material layer can be knitted so as to have greater breathability in one area than in a different area. The material layer can be knit having differing visual patterns and devoid of seams between the differing visual patterns.

The material layer may include one or more apertures. In one embodiment, the material layer may include one or more ribbed sections having a different elasticity than another section of the material layer.

According to another aspect, a pillow includes a material layer having a top layer, a bottom layer and one or more sides separating the top layer from the bottom layer, an interior spaced defined between the top layer and the bottom layer, and a filler disposed in the interior space. The material layer is formed by seamless knitting and is seamless about an entirety of a periphery extending in first direction around the top layer, the bottom layer and the one or more sides.

The material layer may include a plurality of sides. At least two opposed sides of the plurality of sides may be seamless. The material layer may include a seam at a third side of the plurality of sides. The material layer may include an opening at a fourth side of the plurality of sides, opposite to the third side. The material layer may include a fastener at a fourth side of the plurality of sides, opposite to the third side. The fastener may be a releasable fastener.

The material layer can be knit from more than one type of yarn. The yarns may have differing characteristics. For example, one such characteristic is a cooling characteristic.

The material layer can be knit having more than one density of yarn. The varying density can vary the stretch, the breathability and/or cooling ability of the material layer. The pillow component may be knit such that at least one side of the plurality of sides is inwardly curved.

The material layer can be knitted so as to have greater breathability in one area than in a different area. The material layer can be knit having differing visual patterns and devoid of seams between the differing visual patterns. The material layer can be knit such that at least one side of the plurality of sides may be inwardly curved to urge the filler toward a central area of the interior space.

The material layer may include one or more apertures to allow for air flow between the interior space and external atmosphere. The material layer may include one or more ribbed sections having a different elasticity than another section of the material layer. The one or more ribbed sections may be configured to allow for expansion of the material layer.

Other objects, features, and advantages of the disclosure will be apparent from the following description, taken in conjunction with the accompanying sheets of drawings, wherein like numerals refer to like parts, elements, components, steps, and processes.

DETAILED DESCRIPTION

Figure 1:
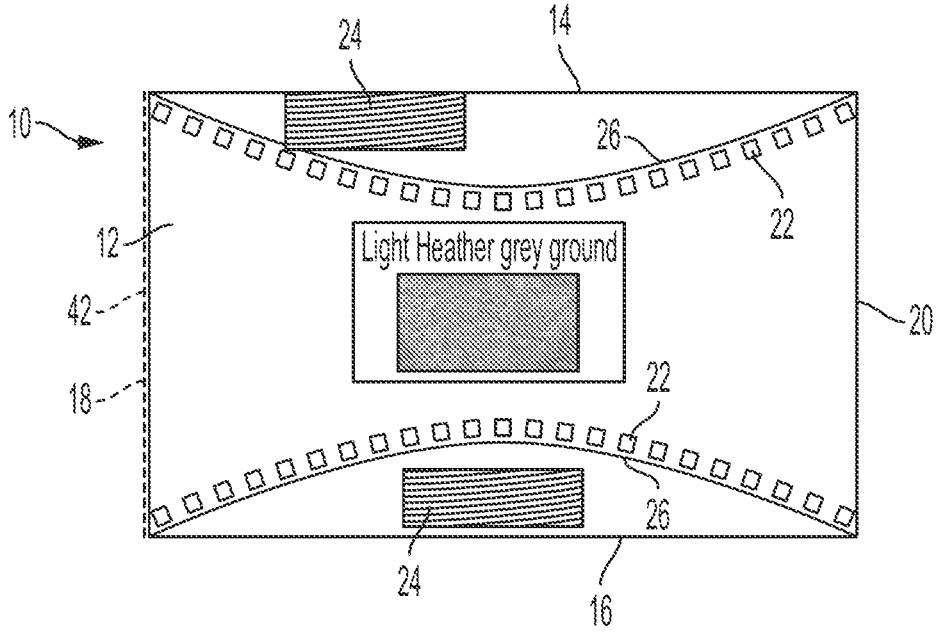
FIG. 1 is a plan view diagram of a pillow component according to an embodiment.

While the present disclosure is susceptible of embodiment in various forms, there is shown in the drawings and will hereinafter be described one or more embodiments with the understanding that the present disclosure is to be considered illustrative only and is not intended to limit the disclosure to any specific embodiment described or illustrated.

Figure 2:
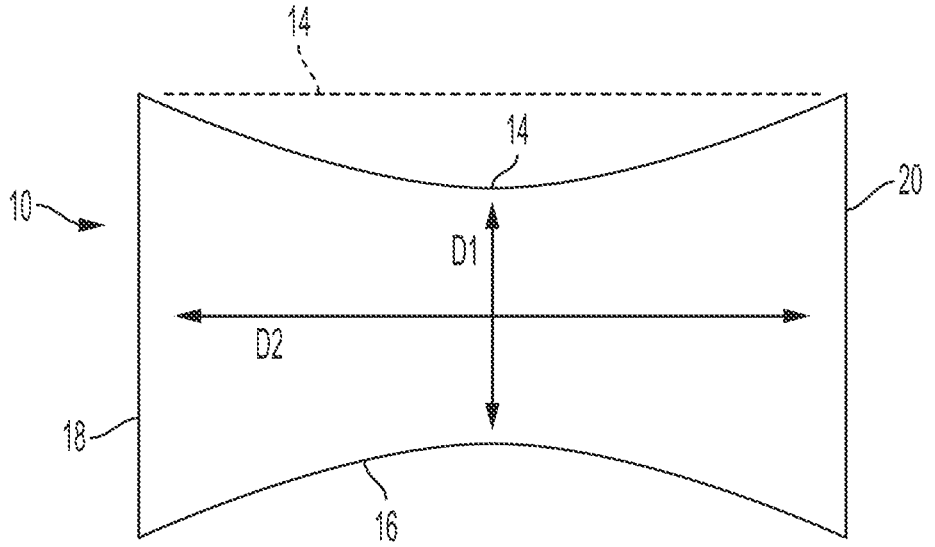
FIG. 2 is another plan view diagram of a pillow component according to an embodiment.

FIG. 1 is a plan view diagram of a pillow component 10 according to an embodiment and FIG. 2 is a plan view diagram showing a variation of the pillow component 10 of FIG. 1, according to an embodiment. The pillow component 10 includes a material layer 12. The material layer 12 includes one or more sides defining a periphery and shape of the pillow component 10 in the plan view. In one embodiment, the one or more sides may be a plurality of sides and include a first side 14, a second side 16 opposite to the first side 14, a third side 18, and a fourth side 20 opposite to the third side 18. In other embodiments, fewer or additional sides may be provided in a predetermined manner during manufacture.

In one embodiment, the first side 14 and the second side 16 may be elongated sides and the third side 18 and the fourth side 20 may be short sides which are shorter than the elongated sides. In one embodiment, opposing sides may be substantially equal in length. In other embodiments, the length of each side may vary. As shown in FIG. 1, in one embodiment, each of the sides may be straight or substantially straight. Alternatively, with reference to FIG. 2, one or more of the sides may be curved. For example, the first side 14 and second side 16 may be inwardly curved, as demonstrated by comparison to the straight first side 14 shown in broken lines. An inwardly curved side may fit a user's body profile, for example around the neck and shoulders, more naturally and comfortably than a substantially straight side. In other embodiments, any or all of the one or more sides may be inwardly curved, outwardly curved, straight or some combination thereof.

The material layer 12 may be produced by a known seamless knitting process such as that used in the production of socks. Thus, the material layer 12 may be seamless around its entire periphery in a first direction D1. For example, the first side 14 and second side 16 may be seamless and the first direction D1 may correspond to a first axis of the material layer 12. The material layer 12 may also include one or more open ends, seams, or fasteners positioned around the periphery in a second direction D2, as discussed further below.

Advantageously, the fabric can be knit so as to vary the materials and the characteristics of the material or materials. The fabric can be knit in one or more areas in one or more different ways. For example, one color of yarn can be used in one area while another color of yarn can be used in a different area. Likewise, one type of yarn can be used in one area while another type of yarn can be used in a different area. In one contemplated product, for example, a pillow cover or pillow component, a yarn with a cooling material can be used in certain areas (for example, around a central portion of the product) while another yarn with lesser cooling characteristics can be used in other areas.

The yarn density and/or type of yarn can be varied to vary, for example, the amount of stretch or resistance to stretch in a specific area or areas. Likewise the density and/or type of yarn can be varied to vary the amount of breathability in a specific area or areas. Also advantageously, the knit can be carried out to create openings, for example, patterns of openings, in the fabric. In still other knitting patterns, the fabric can be kit with a curvature of one or more of the sides such that the material layer 12 may be produced with one or more inwardly or outwardly curved sides in the plan view. Stitch tensions may be increased or decreased during the seamless knitting process at different sections of the material layer 12.

Figure 3:
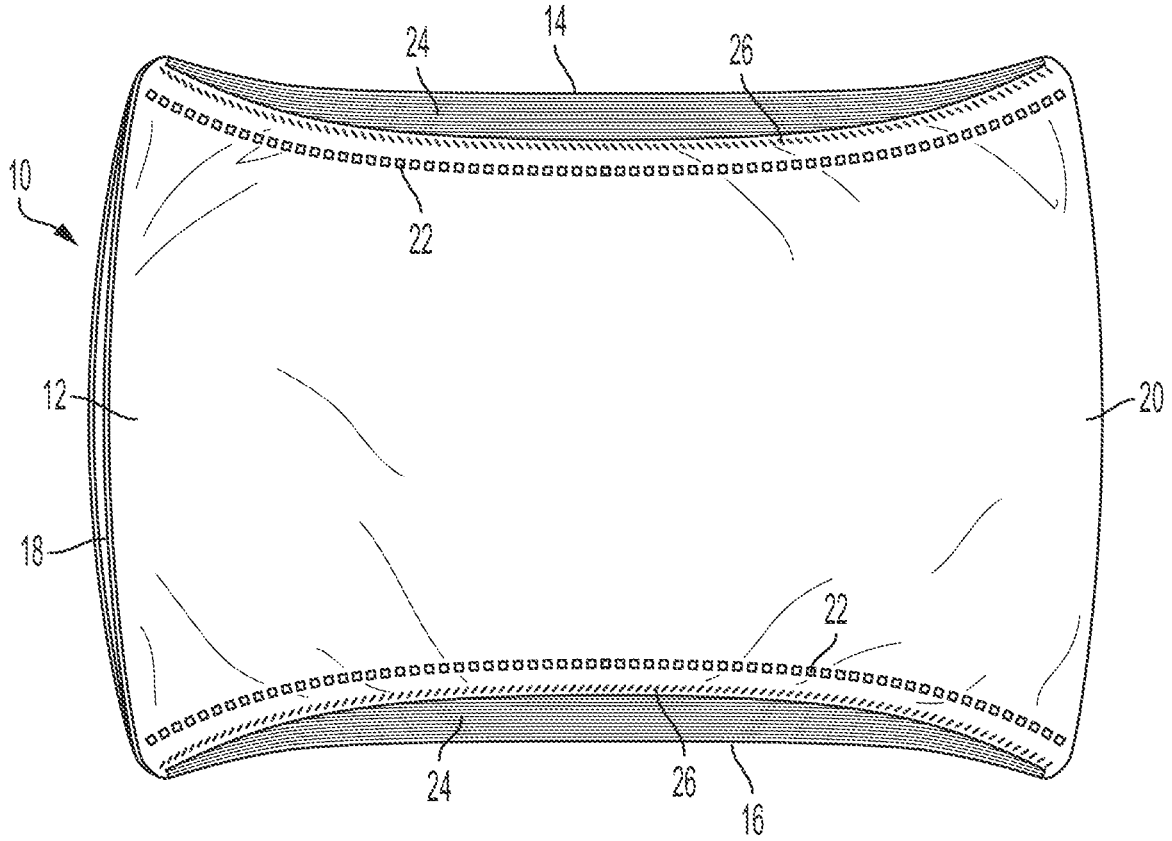
FIG. 3 is a plan view of a pillow component according to an embodiment.

FIG. 3 is a plan view of the pillow component 10 according to an embodiment. Referring to FIGS. 1-3, the material layer 12 may include one or more apertures 22. In a non-limiting embodiment, the apertures 22 may be equally spaced and/or extend along a line or curve substantially matching a line or curve of the first side 14 and/or second side 16. In one embodiment, the apertures 22 may be arranged adjacent to one or more, or any combination of the first side 14, the second side 16, the third side 18 and the fourth side 20. In one embodiment, the apertures 22 may be formed by drop needle stitching or other suitable process. In one embodiment, the apertures 22 may be formed as birds-eye holes during engineering knitting of the material layer 12.

In one embodiment, the material layer 12 may include one or more ribbed sections 24. The ribbed sections 24 may provide a different level of elasticity than other sections of the material layer 12. The ribbed sections 24 may extend along one or more of the sides of the material layer 12. In one embodiment, the ribbed sections 24 extend along the first side 14 and the second side 16. The ribbed sections 24 may extend inward a predetermined distance from the side along which they extend. The ribbed sections 24 may generally follow a profile of the side along which they extend. For example, in one embodiment, the ribbed sections 24 may have an inwardly curved profile.

In one embodiment, the material layer 12 may further include one or more stitching patterns 26 to create a textured look. For example, a zig-zag stitching pattern 26 may be provided to extend along one or both of the first side 14 and the second side 16.

Figure 4:
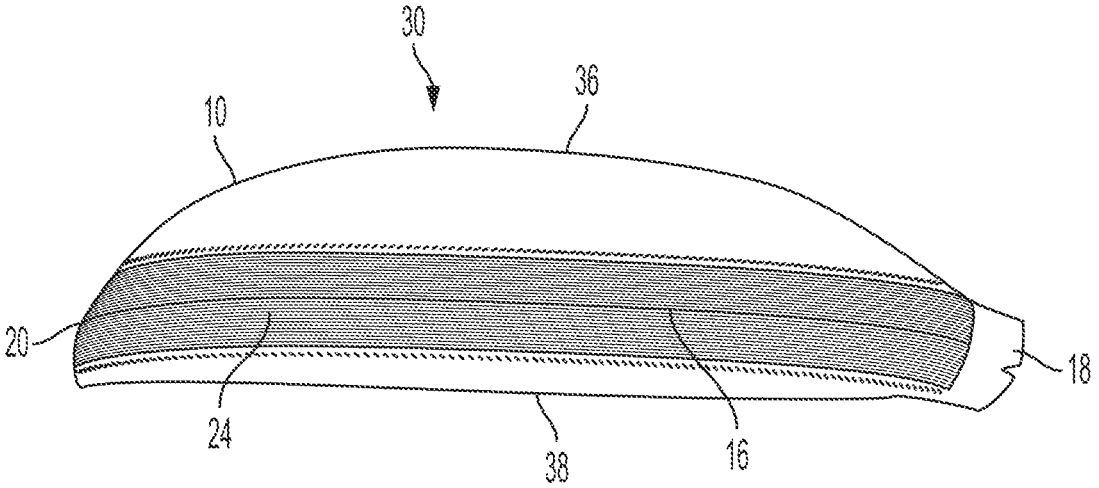
FIG. 4 is a side view of a pillow according to an embodiment.
Figure 5:
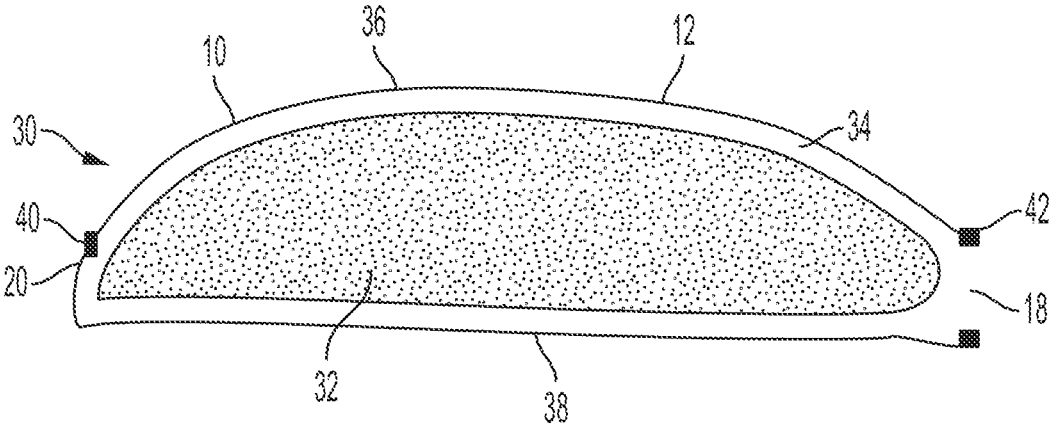
FIG. 5 is a cross-sectional view of the pillow of FIG. 4 according to an embodiment.

FIG. 4 is a side view of a pillow 30 comprising the pillow component 10 of the embodiments above and a filler 32 to provide cushioning and/or support according to an embodiment. FIG. 5 is a cross-sectional view of the pillow 30 of FIG. 4, according to an embodiment. The material layer 12 defines an interior space 34 of the pillow component 10. In one embodiment, the pillow component 10 may be a pillow cover or protector and the filler 32 may be received in the interior space 34. In another embodiment, the pillow component 10 may be a pillowcase and the filler 32 and pillow shell or protector may be received in the interior space 34.

The material layer 12 includes a top layer 36 and a bottom layer 38 made from a single panel of the material layer 12. The interior space 34 is disposed between the top layer 36 and the bottom layer 38. The one or more sides 14, 16, 18, 20 may define a boundary between the top layer 36 and the bottom layer 38. The periphery of the material layer 12 along the first direction D1 may be defined at any location between the third side 18 and the fourth side 20, extending along the top layer 36, the bottom layer 38 and across the first side 14 and the second side 16. The periphery of the material layer 12 along the second direction D2 may be defined at any location between the first side 14 and the second side 16, extending along the top layer 36, the bottom layer 38 and across the third side 18 and the fourth side 20.

Various features of the material layer 12 described in the embodiments above may be disposed on one or both of the top layer 36 and the bottom layer 38. For example, the apertures 22, ribbed sections 24 and the stitching pattern 26 may be disposed on either or both layers 36, 38.

In an embodiment, the one or more apertures 22 are knit into the fabric to provide openings to allow for air flow between the interior space 34 and the external atmosphere through the apertures. Such an air flow allows for the typically cooler atmosphere air to flow into the interior space 34 and typically warmer air of the interior space to egress from the interior space 34. Additionally and for example, a cooling yarn may also be used at or around the aperture-formed areas to that a cooling effect may be provided and/or temperature increases within the interior space may be limited.

The apertures 22 may be formed having a predetermined size, shape and position on the material layer 12 to accommodate a desired level of air flow. For example, a relatively large aperture size may allow increased air flow into and out of the interior space 34 to provide a greater cooling effect, while a relatively small aperture size may restrict air flow into and out of the interior space 34 to provide a reduced cooling effect. Likewise, positioning the apertures 22 may increase or decrease exposure to the atmosphere which may affect flow of air into and out of the interior space 34.

In one embodiment, an inwardly curved side or sides of the material layer 12 is configured to urge the filler 32 toward a central area of the interior space 34. The fabric at the inwardly curved sides may also (optionally) be knitted from a different yarn material so that a desired level of cushioning or support may be maintained in, for example, a central portion of the pillow 30. In one embodiment, the force with which the filler 32 may be urged toward the central area may be controlled by varying the curvature of the side(s) during manufacture and/or varying an elasticity of the ribbed sections 24 during manufacture, for example, by engineered knitting. In addition, the curved side or sides may fit a user's body profile, such as around the neck and shoulders, more naturally and comfortably than a substantially straight side.

As detailed above, the material layer 12 may be formed by a seamless knitting process, such as a circular kiting process, which may include engineering knitting. In one embodiment, upon completion of the seamless (or circular) knitting process, the material layer 12 may be substantially tube-shaped, such that the first side 14 and second side 16 are closed and seamlessly formed, and the third side 18 and fourth side 20 are open. The interior space 34 is defined within the tube-shape. To form the pillow component 10, one or more of the third side 18 and the fourth side 20 may be closed, for example, by stitching, adhesives or the like to form a seam 40. The seam 40 may be formed, for example, by joining adjacent portions of the material layer 12 together in a substantially non-releasable manner. In one embodiment, the adjacent portions are the top layer 36 and the bottom layer 38.

Alternatively, or in addition, one or more of the third side 18 and the fourth side 20 may include a fastener 42. The fastener 42 may be a suitable releasable fastener which may be selectively closed to substantially prevent access to the interior space 34 and opened to allow access to the interior space 34. Examples of suitable releasable fasteners include but are not limited to slide fasteners, hook-and-loop fasteners, buttons, snaps, zippers and the like, or combinations thereof. In other embodiments, one of the third side 18 and fourth side 20 may remain open. Thus, a periphery of the material layer 12 in the direction D2 (FIG. 2) may include one or more of the seam 40, the fastener 42 and an opening (not shown).

In one embodiment, the material layer 12 is a single panel of material. The material layer 12 may be a pillow cover or protector. The pillow cover or protector formed by the material layer 12 includes the seamless first and second sides 14, 16. The pillow cover or protector may also include fastener 42 at the third side 18 and the seam 40 at the fourth side 20. In one embodiment, the material layer 12 may be expandable, for example, by way of the elasticity of the material from which it is formed and/or one or more ribbed sections 24 to accommodate a fillers 32 of different densities, sizes, volumes, or having different gussets heights, or combinations thereof.

In another embodiment, the material layer 12 may be a pillowcase. The pillowcase formed by the material layer 12 may include the seamless first and second sides 14, 16 and the seam 40 at the fourth side 20, as described above. The third side 18 may by formed as an opening through which a pillow cover containing the filler 32 may be received in or removed from the interior space 34.

In the embodiments above, the pillow component 10 having the material layer 12 formed by seamless knitting does not require multiple panels of material to be cut to size and joined together by stitching. Thus, in the embodiments above, a panel cutting process may be avoided and a stitching process can be reduced, in some embodiments, to a single side or two sides along a periphery of the pillow component 10. In addition, in the embodiments above, excess materials or waste may be reduced by way of the reduced or eliminated cutting and stitching processes. That is, having finished edges, no cutting and easier sewing may reduce waste and use of materials compared to known pillow component manufacturing processes. In addition, human error may be reduced during manufacturing because cutting may be eliminated and sewing may be reduced or minimized. Variation of the material layer 12 during manufacture may be reduced or minimized for these reasons as well.

In the embodiments above, the material layer 12 may be produced by engineered knitting in the seamless knitting process. With the engineered knitting technique, a wide range of different knitting structures, textures and constructions on a same piece of fabric may be provided. Thus, the material layer 12 may be produced with desired aesthetics, a desired shape, improved flexibility and support as needed, and reduced pressure points. Different levels of stretch and strength may be provided by programming a shape and density aforementioned during manufacture. Knitting to shape may also improve integrity in the edges and unraveling may be avoided.

Further, in the embodiments above, the pillow component may be produced without bumps or protruding seams in certain locations and may thereby improve comfort. By using a single piece of fabric, even tension to confine the filler in the interior space and more homogenous support may be provided. As noted above, the material layer or yarn, may be made from, for example, wicking yarn, cooling yarn, conductive yarn and other known, suitable materials, to provide different performances and combine with designs. The knitted fabric may also offer desired breathability, while the apertures 22 may provide additional breathability.

It is understood that the relative directions described above, e.g, "upward," "downward," "upper," "lower," "above," "below," "top," "bottom," and the like are used for illustrative purposes only and may change depending on an orientation of the ostomy pouch and/or the patient. Accordingly, this terminology is non-limiting in nature. In addition, it is understood that one or more various features of an embodiment above may be used in, combined with, or replace other features of a different embodiment described herein.

All patents referred to herein, are hereby incorporated herein in their entirety, by reference, whether or not specifically indicated as such within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

The invention claimed is:

1. A pillow component comprising: a material layer having a top layer, a bottom layer and one or more sides separating the top layer from the bottom layer; and an interior spaced defined between the top layer and the bottom layer, the interior space configured to receive a filler, wherein the material layer is formed by seamless knitting and is seamless about an entirety of a periphery extending in a first direction around the top layer, the bottom layer and the one or more sides, wherein the material layer is knit from more than one type of yarn, the more than one type of yarn have differing characteristics from each other type of yarn, the more than one type of yarn having different densities from each other type of yarn, wherein the material layer is knitted so as to have greater breathability in one area than in a different area, and wherein the material layer further includes one or more ribbed sections having a different elasticity than another section of the material layer.

2. The pillow component of claim 1, wherein the material layer comprises a plurality of sides.

3. The pillow component of claim 2, wherein at least two opposed sides of the plurality of sides are seamless.

4. The pillow component of claim 3, wherein the material layer further comprises a seam at a third side of the plurality of sides and an opening at a fourth side of the plurality of sides, opposite to the third side.

5. The pillow component of claim 4, including a releasable fastener on the fourth side of the plurality of sides.

6. The pillow component of claim 2, wherein at least one side of the plurality of sides is inwardly curved.

7. The pillow component of claim 1, wherein the characteristics include cooling characteristics.

8. The pillow component of claim 1, wherein the material layer further includes one or more apertures.

9. The pillow component of claim 1, wherein the material layer is knitted such that one area is has a different visual appearance, and is seamless from another area.

10. A pillow comprising: a material layer having a top layer, a bottom layer and one or more sides separating the top layer from the bottom layer; an interior spaced defined between the top layer and the bottom layer and a filler disposed in the interior space, wherein the material layer is formed by seamless knitting and is seamless about an entirety of a periphery extending in a first direction around the top layer, the bottom layer and the one or more sides, wherein the material layer is knit from more than one type of yarn, the more than one type of yarn have differing characteristics from each other type of yarn, the more than one type of yarn having different densities from each other type of yarn, wherein the material layer is knitted so as to have greater breathability in one area than in a different area, and wherein the material layer further includes one or more ribbed sections having a different elasticity than another section of the material layer, the one or more ribbed sections configured to allow for expansion of the material layer.

11. The pillow of claim 10, wherein the material layer comprises a plurality of sides.

12. The pillow of claim 11, wherein one of the characteristics of differing characteristics includes cooling characteristics.

13. The pillow of claim 11, wherein at least two opposed sides of the plurality of sides are seamless and wherein the pillow further comprises a seam at a third side of the plurality of sides.

14. The pillow of claim 13, wherein the material layer further comprises an opening at a fourth side of the plurality of sides, opposite to the third side.

15. The pillow of claim 14, wherein the material layer further comprises a releasable fastener at a fourth side of the plurality of sides, opposite to the third side.

16. The pillow of claim 10, wherein the material layer is knit having differing visual patterns and is devoid of seams between the differing visual patterns.

17. The pillow of claim 10, wherein at least one side of the plurality of sides is inwardly curved to urge the filler toward a central area of the interior space.

18. The pillow of claim 10, wherein the material layer further includes one or more apertures to allow for air flow between the interior space and external atmosphere.

* * * * *